US011591055B2

(12) United States Patent
Cuesta Zavala

(10) Patent No.: US 11,591,055 B2
(45) Date of Patent: Feb. 28, 2023

(54) AUTOMATIC AND INSTANTANEOUS INFLATING DEVICE

(71) Applicant: Ignacio Cuesta Zavala, Madrid (ES)

(72) Inventor: Ignacio Cuesta Zavala, Madrid (ES)

( * ) Notice: Subject to any disclaimer, the term of this patent is extended or adjusted under 35 U.S.C. 154(b) by 0 days.

(21) Appl. No.: 16/819,197

(22) Filed: Mar. 16, 2020

(65) Prior Publication Data

US 2021/0284299 A1 Sep. 16, 2021

(51) Int. Cl.

| | |
|---|---|
| ***B63C 9/15*** | (2006.01) |
| ***B63C 9/18*** | (2006.01) |
| *B63C 9/13* | (2006.01) |

(52) U.S. Cl.

CPC ..... *B63C 9/155* (2013.01); *B63C 9/18* (2013.01); *B63C 2009/133* (2013.01)

(58) Field of Classification Search

CPC ..... B63C 9/155; B63C 9/18; B63C 2009/133; B63C 2009/0029; B63C 9/24

See application file for complete search history.

(56) References Cited

U.S. PATENT DOCUMENTS 3,308,494 A * 3/1967 Licher ..... B63C 9/24 441/97

5,400,922 A * 3/1995 Weinheimer ..... B63C 9/24 222/192

OTHER PUBLICATIONS

Lang, George. "The CO2 Cartridge . . . and Under-Appreciated Marvel of Technology" Retrieved from https://docplayer.net/51795337-The-co-2-cartridge-an-under-appreciated-marvel-of-technology-george-fox-lang-august-2003-all-rights-reserved.html, Aug. 2003 (Year: 2003).*

* cited by examiner

*Primary Examiner* — Andrew Polay

(57) ABSTRACT

A device is constituted by an inflatable neck float (1), with a U shape placed around the neck and closed by a safety closure (2) to allow perfect fitting around the neck, inside said neck float (1) there is a flexible tube (3) that carries a gas (11), introduced in liquid state and which, upon being released suddenly, will expand and inflate the lifesaving neck float.

3 Claims, 1 Drawing Sheet

AUTOMATIC AND INSTANTANEOUS INFLATING DEVICE

CROSS-REFERENCE TO RELATED APPLICATIONS

Not Applicable

STATEMENT REGARDING FEDERALLY SPONSORED RESEARCH OR DEVELOPMENT

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT INCORPORATION-BY-REFERENCE OF MATERIAL SUBMITTED ON A COMPACT DISC

Not Applicable

BACKGROUND OF THE INVENTION

Field of the Invention

The field of the invention corresponds to the auxiliary sector of the nautical industry.

Background of the Invention

The current procedures and devices for filling the inflatable material are used for devices of higher pressure with greater complexity and with a much higher associated cost than the one to which we refer.

For small inflatable objects, small bottles of CO2 are used, with the inconvenience of being of metal and rigid.

The inventor knows of a distant forerunner which is the Spanish utility model ES-1035885 called "Automatic personal lifesaving device" requested on Jan. 6, 1997; but it deals with a different device that is placed on top of clothing and functions by means of moisture. Very different from the present invention.

The existence has also been detected of the Spanish utility model ES0286904 requested on 16 Nov. 1985 called "Self-inflating lifesaver", but in reality it deals with a belt exclusively for users who are conscious, for which reason it does not reach the technology of the advocated invention that includes users who are unconscious.

The present invention presents a new technology where rigid and metallic material is not used in an area as sensitive as the user's neck and it also presents a very rapid and safe triggering device which is very necessary in the extreme conditions of the device's use.

BRIEF SUMMARY OF THE INVENTION

The present invention, as expressed in the title of this description, refers to an automatic and instantaneous inflating device and in this case suitable for the automatic and instantaneous inflating of a neck float, such as those used by surfers and sailors and that require automatic and instantaneous inflating so that the user's head remains out of the water in case of an accident, independently of whether or not the user is conscious.

In a preferred form of realisation, the device is constituted by an inflatable neck float, of those that are open and placed around the neck and which are closed by a safety closure, being perfectly placed around the neck, without squeezing but without the possibility of coming off over the head, and where inside this neck float a flexible tube is observed that will be the carrier of the gas, a synthetic non-inflammable gas due to the use to which it is directed, to inflate a ring around the subject's heck and gas that is introduced in liquid state and which, upon being released suddenly, will expand and inflate the lifesaving neck float.

The flexible tube, with a resistance of at least 12 bars, and with capacity to resist at least 20 bars, presents circular closures at its ends.

One of these closures is a pressure valve and gas inlet and on the other end the closure is constituted by a resistant membrane that has on its exterior face a small piece of lead wire with a high heating point that in turn is connected to an electric battery, connected in turn to an electronic board managed by an algorithm which will be what decides if the user is unconscious and, if so, will issue an order to the electric battery to heat the wire which will immediately perforate the membrane, releasing in this way the liquid gas which will inflate the neck float in order to carry out its mission.

In both cases, the device has a manual activation button to trigger the gas.

BRIEF DESCRIPTION OF THE DRAWINGS

In order to complement the description that is being made and for the purpose of aiding a better understanding of the characteristics of the invention, a sheet of plans accompanies this descriptive report as an integral part thereof, with the same references indicating the identical elements, and where, as an example but without limitation, the following has been represented.

Figure 1:
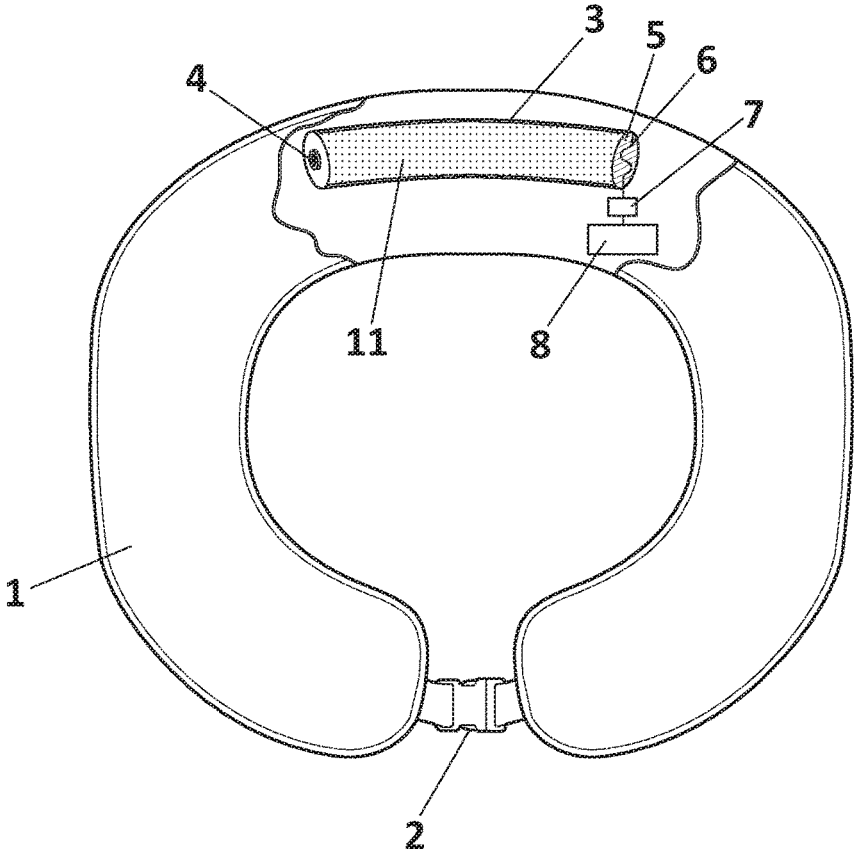
FIG. 1. Plan view of the complete device.
Figure 2:
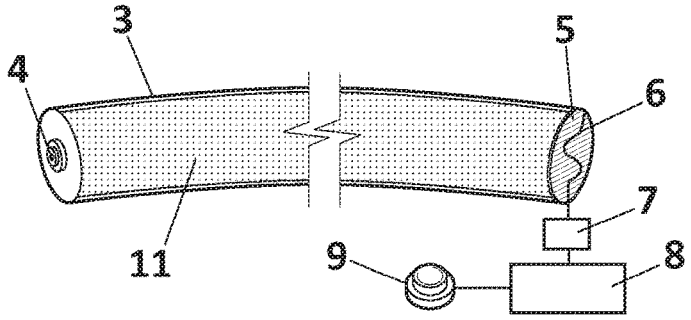
FIG. 2. Plan view of the gas carrier tube and triggering mechanism.
Figure 3:
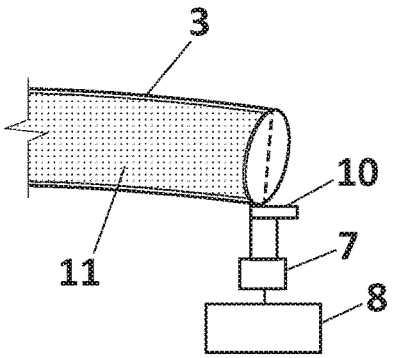
FIG. 3. Plan view of the gas carrier tube and another mechanism triggered by micro-motor.

In these figures the following elements are identified using the same numeration elements:

(1)—Inflatable lifesaving neck float,
(2)—Safety closing of the neck float,
(3)—Flexible gas carrier tube,
(4)—Gas inlet valve,
(5)—Membrane that closes the tube (3),
(6)—Nichrome wire,
(7)—Battery,
(8)—Electronic board,
(9)—Manual triggering button,
(10)—Electric micro-motor.

DETAILED DESCRIPTION OF THE INVENTION

Description of the Preferred Embodiment

The present invention, as expressed in the title of this description, refers to an automatic and instantaneous inflating device suitable for the automatic and instantaneous inflating of a neck float, such as those used by surfers and sailors and that require automatic and instantaneous inflating so that the user's head remains out of the water in case of an accident, independently of whether or not the user is conscious.

In a preferred form of realisation, the device is constituted by an inflatable neck float (1), of the type that are open and placed around the neck and which are closed by a safety closure (2), being perfectly placed around the neck, without squeezing but without the possibility of coming off over the head.

Inside said neck float (1) a flexible tube (3) is observed that will be the carrier of the gas (11), a synthetic non-inflammable gas due to the use to which it is directed, to inflate a ring around the subject's heck and gas that is introduced in liquid state and which, upon being released suddenly, will expand and inflate the lifesaving neck float.

The flexible tube (3), with a resistance of at least 12 bars, but with capacity to resist up to 20 bars, presents circular closures at its ends. Once of these closures is a pressure valve and gas inlet (4) and on the opposite end the closure is constituted by a resistant polyethylene membrane (5) that has on its outer face a small piece of nichrome lead wire of approximately 2 mm in diameter (6) which in turn is connected to an electrical battery (7), which is connected in turn to an electronic board (8) managed by an algorithm which will be what decides if the user is unconscious and, therefore, will issue an order to the electric battery (7) so that it heats the nichrome wire (6) which will immediately perforate the polyethylene membrane (5), thus releasing the liquid gas (11) which will inflate the lifesaving neck float in order to fulfil its mission.

In another preferred realisation, instead of the nichrome wire (6), a micro-motor (10) was used, also activated by the electronic plaque (8) and the battery (7) that rapidly perforates the polyethylene membrane (5) so that the liquid gas (11) expands.

In both cases, the device has a manual activation button (9) to trigger the gas.

This system can be incorporated to other devices that need automatic inflating.

Having sufficiently described the nature of the invention, as well as the way to put it into practice, it must be noted that the above indicated devices represented in the attached drawings are susceptible to modifications in detail insofar as they do not alter its basic principles, established in the above paragraphs and summarised in the following claims.

The invention claimed is:

1. An automatic and instantaneous inflating device comprising an inflatable neck float, with a U shape that is placed around the neck and closes with a safety closure, allowing a tight fit, a synthetic non-inflammable gas, used to inflate the neck float around the subject's neck, this gas is introduced in a liquid state and upon being suddenly released, will expand and inflate the lifesaving neck float and a flexible tube placed inside the neck float that will carry the gas; and where the flexible tube, has a resistance of at least 12 bars and capacity to resist at least 20 bars and has circular closures on each of its ends wherein one of the circular closures is constituted by a pressure valve and gas inlet (4) and on the opposite end the closure is constituted by a resistant polyethylene membrane (5) which has on its exterior face a small nichrome wire (6) of a diameter between 2 mm and 4 mm.

2. The device according to claim 1 wherein the device has a manual activation button (9) to trigger the gas.

3. The device according to claim 1 wherein instead of a nichrome wire (6) a micro-motor (10) is used, also activated by an electronic board (8) and a battery (7) that rapidly perforates the membrane (5) so that the liquid gas (11) may expand.

* * * * *